United States Patent [19]

Mowry

[11] Patent Number: 4,721,296

[45] Date of Patent: Jan. 26, 1988

[54] SHEET MATERIAL HANDLING APPARATUS

[75] Inventor: Harry E. Mowry, Plattsburg

[73] Assignee: Harris Graphics Corporation, Melbourne, Fla.

[21] Appl. No.: 866,697

[22] Filed: May 27, 1986

[51] Int. Cl.[4] ..... B65H 5/30

[52] U.S. Cl. ..... 270/55; 270/57; 198/644

[58] Field of Search ..... 270/53–58; 198/803.7–803.11, 644; 271/204, 205, 206, 82

[56] References Cited

U.S. PATENT DOCUMENTS

| | | | |
|---|---|---|---|
| 2,461,573 | 2/1949 | Schweizer | 270/55 |
| 2,634,971 | 4/1953 | Schweizer | 270/54 |
| 2,796,255 | 6/1957 | Mitchell | 270/57 |
| 2,856,182 | 10/1958 | Cantrell | 270/57 |
| 2,892,627 | 6/1959 | Newhouse | 270/55 |
| 3,951,399 | 4/1976 | Reist | 270/55 |
| 4,236,706 | 12/1980 | Schlough | 270/54 |
| 4,381,056 | 4/1983 | Eberle | 271/204 X |
| 4,477,067 | 10/1984 | Wise | 270/57 |
| 4,479,643 | 10/1984 | Seidel | 270/55 |
| 4,499,834 | 2/1985 | Ruetschle et al. | 270/53 |
| 4,638,906 | 1/1987 | Winiasz | 198/803.9 |
| 4,641,825 | 2/1987 | Mowry et al. | 270/53 |

FOREIGN PATENT DOCUMENTS

| | | | |
|---|---|---|---|
| 2702739 | 9/1977 | Fed. Rep. of Germany | 270/58 |
| 606337 | 7/1960 | Italy | 270/54 |

*Primary Examiner*—E. H. Eickholt

*Attorney, Agent, or Firm*—Tarolli, Sundheim & Covell

[57] ABSTRACT

An apparatus is provided to sequentially form and transport sheet material assemblages to a receiving location. The apparatus includes a collating conveyor assembly which is operated to form the sheet material assemblages. A gripper conveyor assembly sequentially grips sheet material assemblages formed by the collating conveyor assembly and transports them to a receiving location. A receiving conveyor transports the sheet material assemblages from the receiving location. The gripper conveyor assembly includes a plurality of grippers which are sequentially moved beneath the collating conveyor assembly with the grippers fully open and facing upwardly. Sheet material assemblages are sequentially dropped from the collating conveyor assembly downwardly into the upwardly opening grippers. Each of the grippers in turn is closed to clampingly grip the sheet material assemblages. The grippers are then moved to the receiving location and opened with the grippers facing downwardly to drop the sheet material assemblages onto the receiving conveyor.

9 Claims, 10 Drawing Figures

SHEET MATERIAL HANDLING APPARATUS

BACKGROUND OF THE INVENTION

The present invention relates to a new and improved apparatus for sequentially forming and transporting sheet material assemblages.

An apparatus for transferring newspapers from a stuffing machine to a receiving location is disclosed in U.S. Pat. No. 4,479,643. The apparatus illustrated in this patent includes a belt type conveyor which extends beneath downwardly opening pockets of a roter. Upon opening of a roter pocket, the folded leading or lower edge of a newspaper engages a downwardly sloping conveyor belt. This conveyor belt accelerates the leading portion of the newspaper while the trailing portion of the newspaper remains in an open pocket. The newspaper is transported to an inverter having a nip which grips the leading portion of the newspaper. The newspapers leave the inverter in an overlapped stream.

A conveyor apparatus for printed sheet material is disclosed in U.S. Pat. No. 4,381,056. This apparatus includes a wheel having compartments in which printed material is disposed. A plurality of grippers sequentially grip the printed material in each of the compartments of the wheel. When each gripper in turn has been moved to a delivery location, it is opened to release the printed material.

BRIEF SUMMARY OF THE INVENTION

An improved sheet material handling apparatus includes a collating conveyor assembly which forms sheet material assemblages. A gripper conveyor assembly sequentially receives sheet material assemblages from the collating conveyor assembly and transports them to a receiving location.

The collating conveyor assembly includes a plurality of hoppers which hold sheet material. The sheet material is fed from each of the hoppers in turn to collating spaces which are moved past the hoppers. This results in the sequential formation of sheet material assemblages at each of the collating spaces.

While the sheet material assemblages are being moved by the collating conveyor assembly, they are sequentially engaged by grippers in the gripper conveyor assembly. The grippers are sequentially operated from an open condition to a closed condition to clampingly grip each sheet material assemblage in turn. The gripper conveyor assembly moves the sheet material assemblages to a receiving location where the grippers are opened to deposit the sheet material assemblages on a receiving conveyor.

In one specific embodiment of the invention, the collating conveyor assembly has downwardly opening collating spaces from which the sheet material assemblages are dropped into the upwardly opening grippers of the gripper conveyor assembly. In this embodiment of the invention, the grippers are inverted as the sheet material assemblages are transported to the receiving location. Therefore, each gripper is facing downwardly at the receiving location and can be opened to drop a sheet material assemblage onto the receiving conveyor.

Accordingly, it is the object of this invention to provide a new and improved apparatus for sequentially forming and transporting sheet material assemblages and wherein the apparatus includes a collating conveyor assembly which forms the sheet material assemblages and a gripper conveyor assembly which clampingly grips each of the sheet material assemblages in turn.

Another object of this invention is to provide a new and improved apparatus as set forth in the preceding object and wherein the sheet material assemblages are dropped downwardly from the collating conveyor assembly into upwardly opening grippers of the gripper conveyor assembly.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
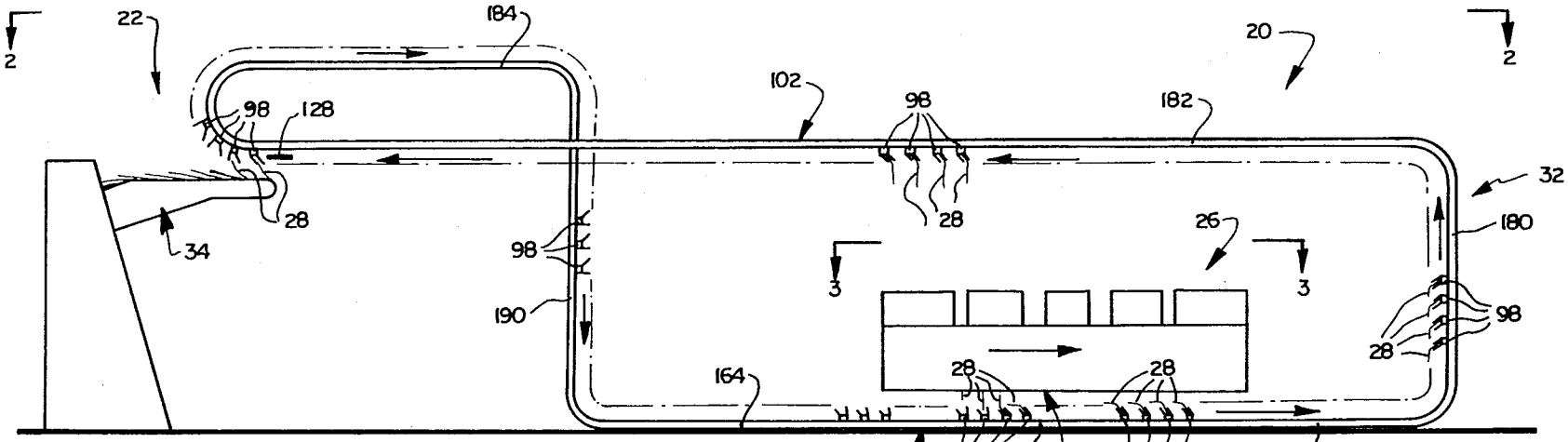
FIG. 1 is a schematic elevational view of a sheet material handling apparatus constructed in accordance with the present invention and illustrating the relationship between a collating conveyor assembly, a gripper conveyor assembly and a receiving conveyor.
Figure 2:
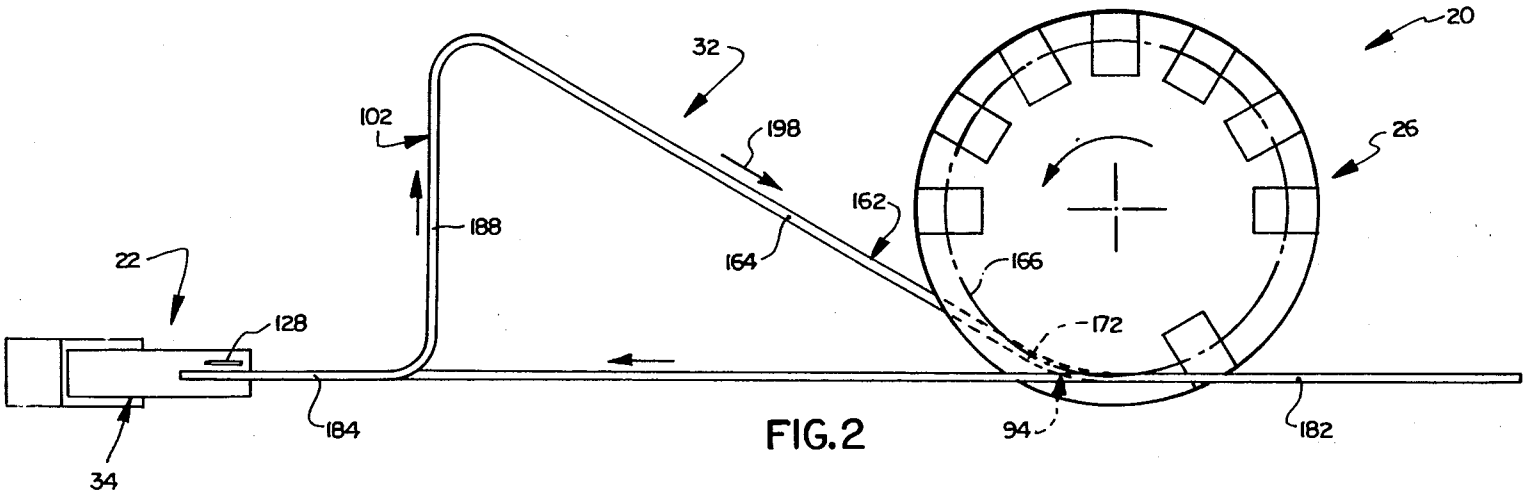
FIG. 2 is a schematic plan view taken generally along the line 2—2 of FIG. 1, further illustrating the construction of the sheet material handling apparatus.
Figure 3:
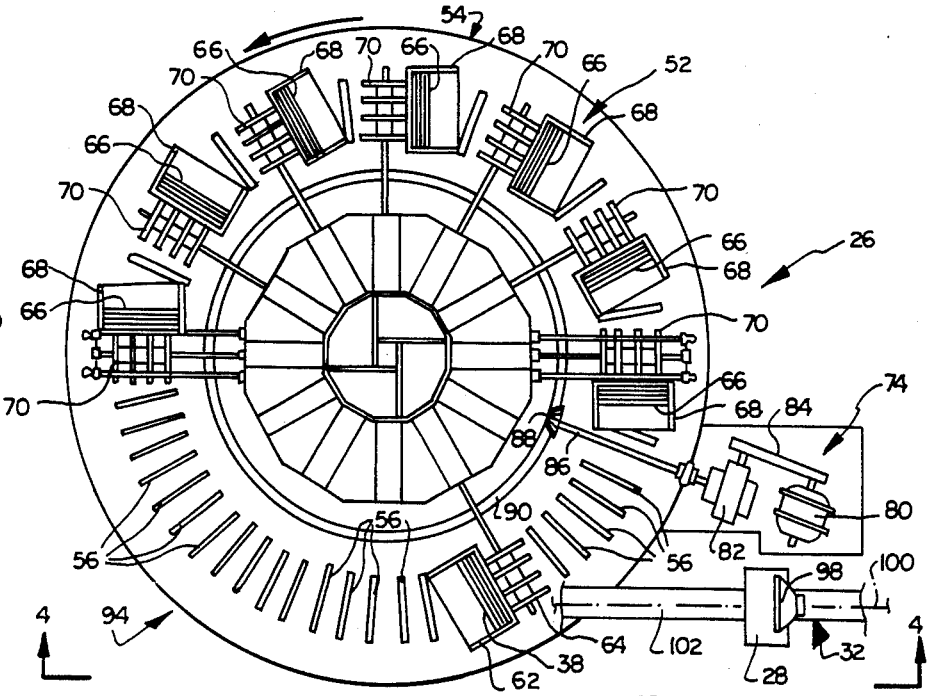
FIG. 3 is a plan view taken generally along the line 3—3 of FIG. 1, illustrating the construction of the collating conveyor assembly.
Figure 4:
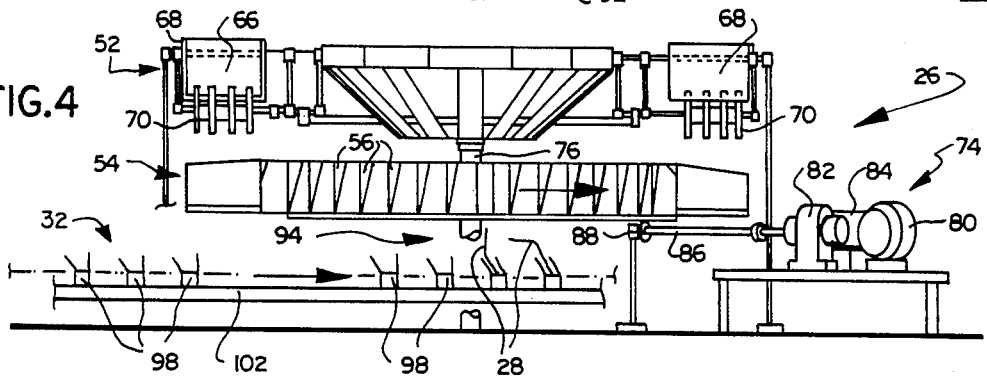
FIG. 4 is an elevational view, taken generally along the line 4—4 of FIG. 3, illustrating the relationship between the collating conveyor assembly and the gripper conveyor assembly.

A sheet material handling apparatus 20 (FIGS. 1 and 2) forms sheet material assemblages and transports them to a receiving station 22. The sheet material handling apparatus 20 includes a collating conveyor assembly 26 (FIGS. 3 and 4) which is operable to form sheet material assemblages 28 (FIGS. 1 and 4). A gripper or delivery conveyor assembly 32 (FIGS. 1, 2 and 4) sequentially grips sheet material assemblages 28 formed by the collating conveyor assembly 26 and transports them to the receiving station 22 (FIGS. 1 and 2). A receiving conveyor 34 transports the sheet material assemblages 28 to a location for further processing.

Although the sheet material of assemblages 28 could take many different forms, for example a collection of individual sheets, a booklet or a group of signatures, the sheet material assemblages 28 are newspapers. Each of the newspapers 28 has a jacket or folded outer cover section 38 (FIG. 5) into which inner sections are stuffed during operation of the collator conveyor assembly 26. The jacket 38 has a folded or closed edge portion 40 and cut or open edge portions 42. A headline side 44 of the jacket 38 extends between the folded edge portion 40 and one of the cut or open edge portions 42. Similarly, a back side 46 extends between the closed edge portion 40 and the other cut or open edge portion 42.

Figure 5:
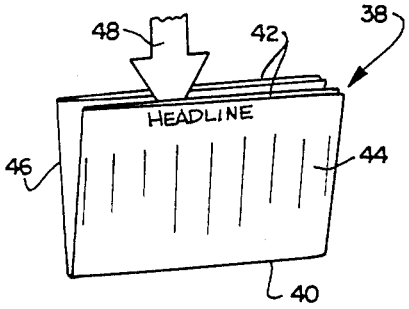
FIG. 5 is a shematic illustration of the manner in which a sheet material assemblage is formed by the collating conveyor assembly of FIGS. 3 and 4.

During operation of the collator conveyor assembly 26, the inner sections of the newspapers are inserted into the opened jacket 38 in the manner indicated schematically by the arrow 48 in FIG. 5, to form a complete newspaper. It should be understood that sheet material assemblages 28 could be articles other than newspapers. It should also be understood that the sheet material assemblages could be formed in an orientation other than the upright orientation of FIG. 5.

Collator Conveyor Assembly

Since the illustrated sheet material assemblages 28 are newspapers, the collator conveyor assembly 26 is a known newspaper stuffing or assembling machine. The collator conveyor assembly 26 (FIGS. 3 and 4) includes a stationary sheet material infeed mechanism 52 which is disposed directly above a movable rotor or collating conveyor 54 having a plurality of collating spaces 56. In the case of the illustrated newspaper stuffing machine, the collating spaces 56 are bottom opening pockets.

The sheet material infeed mechanism 52 includes a jacket hopper 62 (FIG. 3) in which a plurality of the jackets 38 are located. The jackets 38 are sequentially fed from the stationary hopper 62 into the pockets 56 of the circular rotor 54 by a sheet feed mechanism 64 with the headline sides 44 of the jackets facing in the direction of movement of the pockets 56. As the rotor 54 moves the circular array of pockets 56 in a counterclockwise direction (as viewed in FIG. 3), inner sections 66 are fed from hoppers 68 by sheet fed mechanisms 70. Of course, the number of inner sections fed from the hoppers 68 will vary depending upon the size of a particular newspaper or sheet material assemblage.

A drive mechanism 74 rotates the rotor 54 at a constant speed about a centerpost 76 (FIG. 4) so that the open upper ends of the pockets 56 sequentially move past the stationary circular array of hoppers 62 and 68. The drive assembly 74 includes a motor 80 which is connected with a speed reducer 82 by a belt 84 (FIGS. 3 and 4). During operation of the motor 80, a drive shaft 86 rotates a pinion gear 88, disposed in meshing engagement with a ring gear 90 fixedly connected with the rotor 54. Rotation of the pinion gear 88 rotates the rotor 54 in a counterclockwise direction as viewed in FIG. 3.

As each of the pockets 56 goes through a discharge station 94, a cam control mechanism effects movement between opposite sides of the pocket to open the lower end of the pocket. As a pocket 56 opens, a newspaper 28 is dropped from the pocket downwardly to the gripper conveyor assembly 32 (FIGS. 7–10). The manner in which the collator conveyor assembly 26 is constructed is generally the same as is disclosed in U.S. Pat. No. 2,461,573 and will not be further described herein.

Although a specific collator conveyor assembly 26 having a circular construction has been illustrated herein, the collator conveyor assembly could have a different construction. For example, the collator conveyor assembly could have a linear construction similar to the constructions shown in, U.S. Pat. Nos. 4,236,706 and 4,499,834 and 4,641,825 by Mowry et al. and entitled Collator. Although the sheet material assemblages 28 are preferrably dropped to the gripper conveyor assembly 32 from either an arcuate or linear collator conveyor, the sheet material assemblages could be transferred between conveyors in other ways if desired.

Gripper Conveyor Assembly

Figure 6:
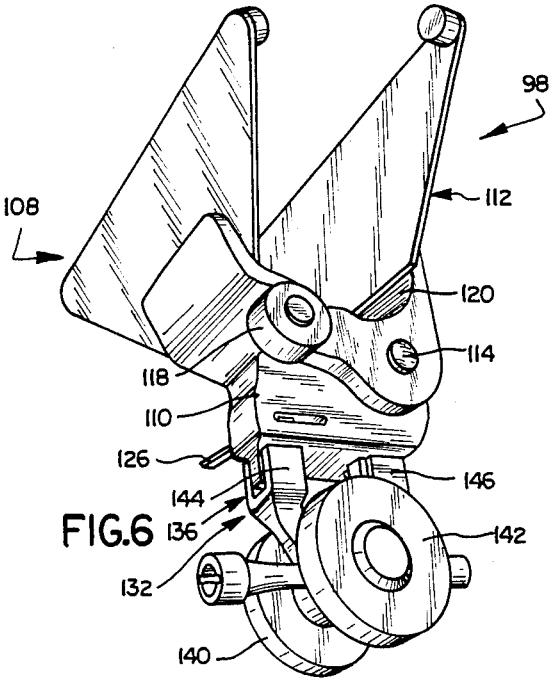
FIG. 6 is a pictorial illustration of a gripper and chain link of the gripper conveyor assembly.
Figures 7, 8, 9, 10:
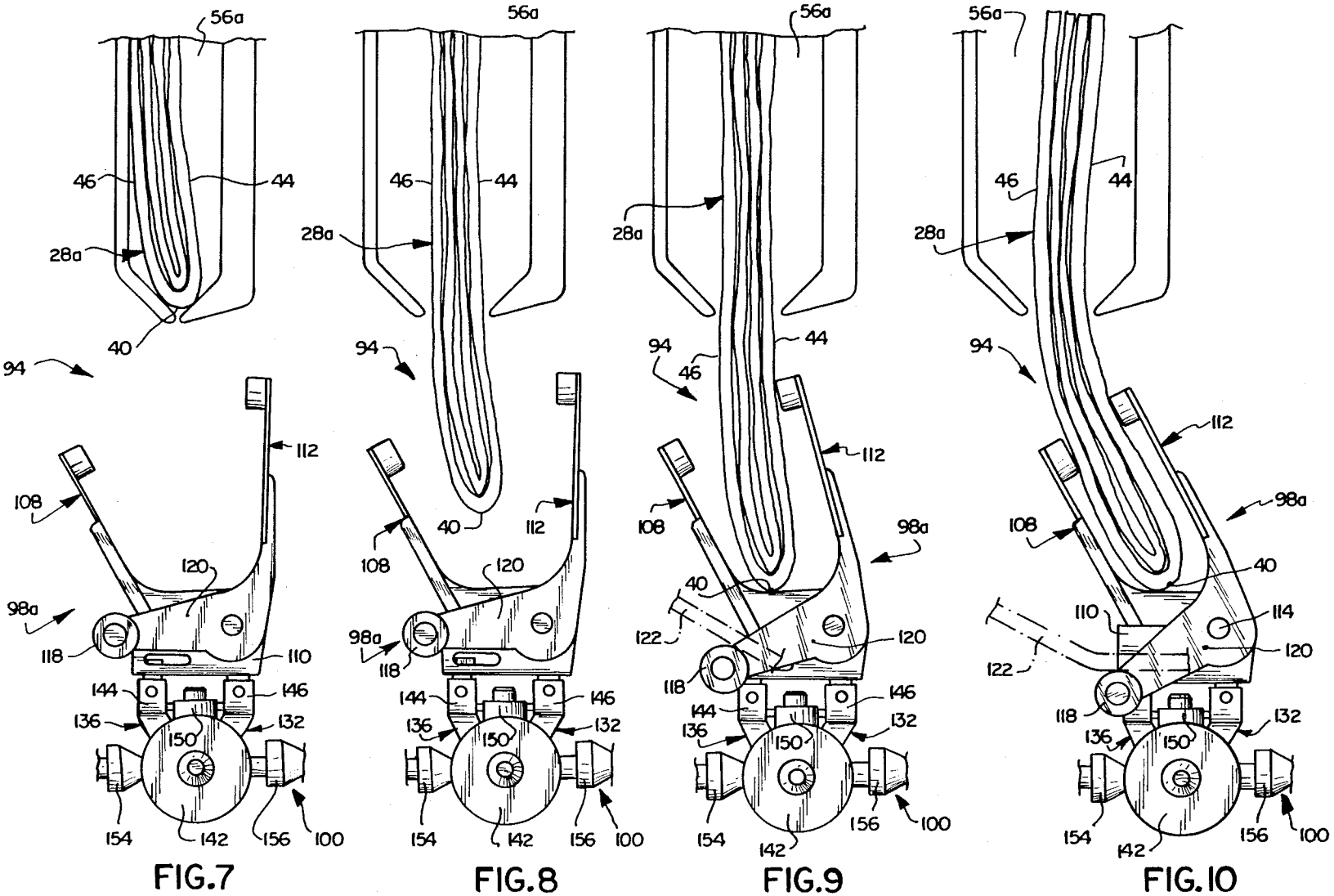
FIG. 7 illustrates the relationship between a fully open gripper of the gripper conveyor assembly and a closed pocket of the collating conveyor assembly.
FIG. 8 is an illustration of the relationship between the gripper of FIG. 7 and a sheet material assemblage immediately after a pocket of the collating conveyor assembly opens.
FIG. 9 is an illustration of the gripper of FIG. 8 in a partially closed condition.
FIG. 10 is an illustration of the gripper of FIG. 9 in a fully closed condition clampingly engaging a sheet material assemblage.

The gripper conveyor assembly 32 includes a plurality of identical grippers 98 (FIG. 6) which are interconnected by a conveyor chain 100 (FIG. 7). The conveyor chain 100 is movable at a constant speed along a track 102 which has been shown schematically in FIGS. 1–4. The track 102 extends in a continuous loop from the discharge station 94 to the receiving station 22 and back to the discharge station.

The grippers 98 are sequentially closed to engage the newspapers 28 at the discharge station 94 (FIG. 4) while the newspapers are being transported by the rotor 54 of the collator conveyor 26. The grippers 98 are then moved along the track 102 by the conveyor chain 100 from the discharge station 94 to the receiving station 22 (FIG. 1). At the receiving station 22, the grippers 98 are opened and the newspapers are dropped from the grippers.

Each of the identical grippers 98 includes a stationary clamp arm 108 (FIG. 6) which is fixedly connected to a base section 110 of the gripper. A movable clamp arm 112 is pivotally supported on the base 110 for movement about the central axis of a shaft 114.

The gripper 98 is illustrated in FIGS. 6, 7 and 8 in a fully open and upwardly facing position. In order to grip a newspaper, the movable clamp arm 112 is rotated toward the stationary clamp arm 108. To rotate the movable clamp arm 112, a roller 118 on an actuator arm 120 (FIG. 6) engages a stationary cam 122 shown in dash lines in FIGS. 9 and 10. This rotates the movable clamp arm 112 in a counterclockwise direction (as viewed in FIGS. 7–10) from the fully opened position of FIGS. 7 and 8 to the closed position of FIG. 10.

If the gripper 98 is to clamp a relatively thin newspaper 28, the movable clamp arm 112 is moved closer to the stationary clamp arm 108. To accomplish this, the cam 122 is moved downwardly from the position shown in dash lines in FIGS. 9 and 10. Rightward (as viewed in FIGS. 9 and 10) movement of the gripper 98 then results in the movable clamp arm 112 being rotated further in a counterclockwise direction.

A clutch (not shown) is operable to hold the movable clamp arm 112 to any one of the numerous closed positions between the fully opened position of FIGS. 7 and 8 and a closed position in which the movable clamp arm 112 cooperates with the stationary clamp arm 108 to clampingly grip a newspaper 28 of any desired thickness. Since the clutch assembly is operable to hold the movable clamp arm 112 in any one of a plurality of closed positions, the gripper 98 can be used to clampingly grip newspapers of different thicknesses.

Once the gripper 98 has engaged a newspaper at the discharge station 94, the gripper remains in a closed condition firmly gripping the newspaper. The conveyor chain 100 then moves the gripper 98 and newspaper 28 along the track 102 from the discharge station 94 (FIG. 1) beneath the collator conveyor 26 to the receiving station 22 above the conveyor 34. As the gripper 98 moves from the discharge station 94 to the receiving station 22, the gripper is inverted from an upwardly facing orientation to a downwardly facing orientation.

At the receiving station 22, an actuator lever 126 (FIG. 6), projecting from a side of the gripper 98 opposite from the actuator arm 120, engages a stationary abutment 128 (FIGS. 1 and 2). Engagement of the actuator lever 126 with the stationary abutment 128 operates the clutch assembly in the gripper 98 to release the movable clamp arm 112 for movement from the closed position of FIG. 10 back to the fully opened position of FIG. 7 under the influence of a biasing spring. This results in a newspaper 28 being dropped onto the receiving conveyor 34. Although the gripper 98 could have many different constructions, such as the construction shown in U.S. Pat. No. 4,381,056, a preferred embodiment of the gripper 98 has the same construction as shown in U.S. patent application Ser. No. 790,431 filed Oct. 23, 1985 by Michael E. Winiasz and entitled Gripper Assembly.

The conveyor chain 100 (FIG. 7) interconnects the grippers 98 and is formed of a plurality of identical links 132. Depending upon the spacing between the pockets 56 of the collator conveyor rotor 54, a gripper 98 is connected to every other link or every third link 132 of the chain 100 so that the spacing between grippers is the same as the spacing between the pockets 56. Thus, as the pockets 96 move through the discharge station 94, there is a gripper 98 beneath each pocket.

Each of the identical chain links 132 includes a one-piece cast metal body section 136 (FIG. 6). A pair of rollers 140 and 142 are disposed on opposite sides of the body section 136. A pair of upwardly extending brackets 144 and 146 are provided on the body section 136. The brackets 144 and 146 receive downwardly projecting flanges on the base 110 of the gripper 98. The gripper 98 is releasably connected with the chain link 136 by suitable pins which extend through holes formed in the brackets 144 and 146 and in the downwardly extending projections on the base 110.

A guide roller 150 (FIG. 7) is rotatably supported on the body section 136 of the link 132. The roller engages opposite side surfaces of a slot formed in the track 102.

During movement of the chain links 132 along the track 102, the gripper rollers 140 and 142 (FIG. 6) roll on the track. The guide rollers 150 (FIG. 7) engage a slot in the track to stabilize the chain links. When the grippers 98 are in the upwardly facing orientation shown in FIG. 7–10, the rollers 140 and 142 roll along the portion of the track opposite from the slot engaged by the guide roller 150. When the grippers 98 face downwardly, the rollers 140 and 142 roll along inner side surfaces of the track adjacent to the slot engaged by the guide roller 150.

To enable the conveyor chain 100 to flex as it goes around curves, universal joints 154 and 156 (FIGS. 7–10) are provided between adjacent links. The universal joints 154 and 156 are formed by sockets at the leading ends of the chain links 132 and by plugs at the trailing ends of the chain links. Although many different types of known chain links could be utilized if desired, in one specific preferred embodiment of the invention, chain links 132 cooperate with a guide track 102 and are constructed in the manner disclosed in U.S. Pat. No. 4,638,906 by Michael E. Winiasz and entitled Conveyor Assembly.

The gripper conveyor track 102 (FIGS. 1 and 2) has a horizontal lower section or run 162 with a straight portion 164 (FIG. 2) which extends tangentially to the circular central axis 166 of a path along which the pockets 56 (FIG. 3) of the collating conveyor rotor 54 move. An arcuate portion 172 (FIG. 2) of the lower track section 162 extends from the straight portion 164 of track through the discharge station 94. The arcuate portion 172 of the track 102 is disposed directly beneath and has the same arc and center of curvature as the circular central axis 166 of the path along which the pockets 56 move. The arcuate portion 172 of the track extends through the entire extent of the discharge station 94 and is connected with a straight horizontal portion 176 (FIG. 1) of track. Thus, when the grippers 98 move along the track 102 through the discharge station 94, they move beneath the pockets 56 and are aligned with the central portions of the pockets.

The track 102 moves upwardly from the horizontal lower section 164 to a vertical section 180 (FIG. 1). The track then curves to an upper horizontal section 182 which extends directly over the lower horizontal portion 176 and across the collator conveyor 26 (see FIGS. 1 and 2) to the receiving station 22. At the receiving station 22, the track 102 curves upwardly to an upper horizontal section 184 which is disposed above the section 182 of the track 102 at the receiving station 22. A second horizontal upper section 188 of the track 102 extends perpendicular to the section 182 of the track (see FIG. 2) to a downwardly extending section 190 (FIG. 1). The downwardly extending section 190 (see FIG. 1) is connected with the left (as viewed in FIGS. 1 and 2) end portion of the lower horizontal track section 162.

Operation

During the operation of the sheet material handling apparatus 20, sheet material assemblages, that is newspapers 28, are formed during operation of the collator conveyor assembly 26. Thus, as the rotor 54 and pockets 56 are turned in a counterclockwise direction (as viewed in FIG. 3) by operation of the motor 80, jackets 38 are fed by a sheet feed mechanism 64 into the open ends of each of the pockets in turn. The jackets 38 are fed into the pockets 56 with the headline or front side 44 of the jackets leading or facing in the direction of movement of the pockets. As the rotor 54 sequentially moves the pockets 56 beneath the hoppers 68, inner sections 66 are fed by sheet feed mechanisms 70 into the jackets 38 in the pockets until a newspaper 28 containing a desired number of sections has been formed.

Continued rotation of the rotor 54 brings each of the pockets 56 in turn to the discharge station 94 (FIG. 4). When a pocket **56*a* (FIG. 7) enters the discharge station 94, a lower end portion of the pocket is closed. At this time, a gripper 98*a* enters the discharge station 94. At the beginning of the arcuate portion 172 of the track (FIG. 2), the gripper 98*a* (FIG. 7) moves into vertical alignment with the central axis 166 along which the pocket 56*a* travels and is in a fully opened and upwardly facing orientation. The gripper 98*a* and pocket 56*a* move through the discharge station 94** at the same speed and remain in vertical alignment with each other.

As the pocket **56*a* moves through the initial portion of the discharge station 94, the lower end of the pocket 56*a* is opened (FIG. 8) and a completed newspaper 28*a* falls downwardly toward the upwardly opening gripper 98*a*. Therefore, the lower end portion of the newspaper 28*a* moves into the space between the clamp arms 108 and 112 while the upper portion of the newspaper 28*a* remains in the pocket 56*a*. The pocket 56*a* and gripper 98*a* cooperate to hold the newspaper 28*a*** against movement from its intended downward path.

As the gripper 98*a* and pocket 56*a* continue to move together at the same constant speed through the discharge station 94, the folded leading edge 40 of the newspaper 28*a* engages the base 110 on the gripper 98*a*. Immediately thereafter, the roller 118 on the gripper actuator arm 120 engages the stationary cam 122. Continued rightward (as viewed in FIG. 9) movement of the gripper 98*a* and pocket 56*a* through the discharge station 94 results in the actuator arm 120 being pivoted in a counterclockwise direction (as viewed in FIG. 9) by the cam 122. As this occurs, the movable clamp arm 112 pivots from the fully open position toward a closed position.

When the gripper 98*a* approaches the end of the discharge station 94, the cam 122 will have actuated the gripper 98*a* to the fully closed position of FIG. 10. At this time, the lower portion of the newspaper 28*a* is clampingly gripped between the stationary and movable clamp arms 108 and 112. The upper portion of the newspaper 28*a* is still in the pocket 56*a* so that the newspaper is restrained against movement. The headline page 44 of the newspaper 28 faces in the direction in which both the pocket 56*a* and gripper 98*a* are moving, that is toward the right as viewed in FIG. 10.

As the gripper 98*a* leaves the discharge station 94, the gripper moves from the arcuate section of track 172 onto the linear section 176 of track. As this occurs, the paths of movement of the pocket 56*a* and gripper 98*a* diverge and the newspaper 28*a* is withdrawn from the open pocket. The open pocket 56*a* is then closed to receive a jacket 38 from the hopper 62 (FIG. 3). The manner in which the pocket 56*a* is opened and closed is generally the same as disclosed in U.S. Pat. No. 2,634,971 and will not be further described herein.

After the gripper 98*a* has left the discharge station 94, it travels at a constant speed along the horizontal section 176 of the track 102 (see FIG. 1). The gripper then moves up the vertical section of track 180 to the horizontal section 182 which extends across the top of the collator conveyor 26. The gripper 98*a* moves along the horizontal section 182 with the newspaper 28*a* hanging downwardly in the manner indicated schematically in FIG. 1.

When the gripper 98*a* reaches the receiving station 22, the actuator lever 126 (FIG. 6) engages the stationary abutment 128. This releases the clutch in the gripper 98*a*. When the gripper clutch is released, a spring pivots the movable clamp arm 112 away from the stationary clamp arm 108 and the newspaper is dropped onto the conveyor 34 at the receiving station.

The newspapers 28 are sequentially deposited in an overlapping stream on the conveyor 34 with the folded edge portions 40 of the newspapers leading and the headline sides 44 downwardly. A stream of overlapped newspapers 28 is conducted by the conveyor 34 to a stacker and tyer machine (not shown) which forms the newspapers into bundles.

When the gripper 98*a* opens to release the newspaper 28*a* at the receiving station 22, the gripper faces downwardly. However, immediately after releasing the newspaper at the receiving station 22, the gripper 98*a* moves along an arcuate section of track to the horizontal upper section 184 of the track. The open gripper then moves along the upper section 184 of track in an upwardly facing orientation.

The gripper 98*a* moves from the second upper horizontal section 188 of track to the downwardly extending vertical section 190 of track. The open gripper 98*a* then moves from the vertical section 190 of track back to the horizontal lower section 164 of track. When the gripper 98*a* is moving along the horizontal lower section 164 of track toward the discharge station 94, the gripper is in an open upwardly facing orientation (FIG. 7). The gripper 98*a* remains open until it is again closed by the cam 122 at the discharge station 94 (FIGS. 9 and 10).

Conclusion

An improved sheet material handling apparatus 20 includes collating conveyor assembly 26 which forms sheet material assemblages 28. A gripper conveyor assembly 32 sequentially receives sheet material assemblages 28 from the collating conveyor assembly 26 and transports them to a receiving location.

The collating conveyor assembly 26 includes a plurality of hoppers 62 and 68 which hold sheet material 38 and 66. The sheet material is fed from each of the hoppers 62, 68 in turn to collating spaces 56 which are moved past the hoppers. This results in the sequential formation of sheet material assemblages 28 at each of the collating spaces 56.

While the sheet material assemblages 28 are being moved by the collating conveyor assembly 26, they are sequentially engaged by grippers 98 in the gripper conveyor assembly 32. The grippers 98 are sequentially operated from an open condition (FIG. 7) to a closed condition (FIG. 10) to clampingly grip each sheet material assemblage 28 in turn. The gripper conveyor assembly 26 moves the sheet material assemblages 28 to a receiving location 22 where the grippers 98 are opened to deposit the sheet material assemblages onto a receiving conveyor 34.

In one specific embodiment of the invention, the collating conveyor assembly 26 has downwardly opening collating spaces 56 from which the sheet material assemblages 28 are dropped into the upwardly opening grippers 98 of the gripper conveyor assembly 32. In this embodiment of the invention, the gripper assemblies 98 are inverted as the sheet material assemblages 28 are transported to the receiving location 22. Therefore, each gripper 98 is facing downwardly at the receiving location 22 and can be opened to drop the sheet material assemblages 28 onto the receiving conveyor 34.

Having described a specific preferred embodiment of the invention, the following is claimed:

1. An apparatus comprising a plurality of hoppers for holding sheet material, first conveyor means defining a plurallity of collating spaces movable past each of said hoppers in turn, feed means for feeding sheet material from each of said hoppers to each of said collating spaces in turns during movement of said collating spaces past said hoppers to sequentially form sheet material assemblages at each of said collating spaces, and second conveyor means for sequentialy gripping the sheet material assemblages being transported by said first conveyor means and conveying the gripped sheet material assemblages away from said collating spaces, said second conveyor means including a plurality of gripper means each of which is operable from an open condition to a closed condition to clampingly grip a sheet material assemblage which is at least partially disposed in one of said collating spaces, said first conveyor means including means for enabling the sheet material assemblages to drop downwardly from each of said collating spaces in turn upon sequential movement of the collating spaces to a first location, said second conveyor means including means for moving each of said plurality of gripper means in turn beneath said first conveyor means at the first location with each of said gripper means being movable into alignment with a respective collating space at least along a portion of the path of movement of the gripper along the first location and in the open condition and opening upwardly at the beginning of the first location to enable sheet material assemblages to sequentially drop downwardly into said gripper means, and said second conveyor means including means for operating each of said gripper means in turn from the open condition to the closed condition to clamping grip the lower portion of the sheet material assemblage at the first location while the upper portion of the sheet material assemblage is disposed in a respective collating space in said first conveyor means.

2. An apparatus as set forth in claim 1 wherein said first conveyor means and said second conveyor means have the same speed of movement.

3. An apparatus as set forth in claim 1 wherein each of said gripper means is sequentially movable from a first location where each of said gripper means is operable from the open condition to the closed condition to grip a sheet material assemblage which is at least partially disposed in one of said collating spaces to a second location where each of said gripper means is operable from the closed condition to the open condition to release the sheet material assemblage, each of said gripper means opening upwardly when in the open condition at the first location and opening downwardly when in the open condition at the second location.

4. An apparatus as set forth in claim 1 further including third conveyor means for transporting sheet material assemblages received from said second conveyor means, said second conveyor means including means for moving each of said gripper means in turn above said third conveyor means at a second location with each of said gripper means in the closed condition gripping a sheet material assemblage and means at the second location for operating each of said gripper means in turn from the location condition to the open condition to drop sheet material assemblages onto said third conveyor means.

5. An apparatus comprising a plurality of hoppers for holding sheet material, said hoppers being diposed in a circular array, a plurality of pockets disposed in a circular array beneath the circular array of hoppers, each of said pockets having a lower end portion which is operable between open and closed conditions, means for moving each of said pockets along a circular path coextensive with the circular array of pockets in turn past said hoppers with the lower end portions of said pockets in the closed condition, feed means for feeding sheet material from said hoppers into said pockets as said pockets move past said hoppers to form sheet material assemblages in said pockets, a gripper conveyor for sequentially gripping the sheet material assemblages transported by said pockets and conveying the gripped material assemblages away from said pockets, said gripper conveyor comprising a plurality of grippers operable from an open condition to a closed condition, means for sequentially moving grippers beneath said circular array of pockets along at least a partially arcuate path coextensive with said circular path of movement of said pockets with said grippers in the open condition and in an orientation in which said grippers open upwardly, means for opening the lower end portions of said pockets in turn to drop the sheet material assemblages downwardly into said upwardly opening grippers, and means for operating each of said grippers in turn from the open condition to the closed condition to clampingly engage lower end portions of sheet material assemblages dropped from each of said pockets.

6. An apparatus as set forth in claim 5 further including conveyor means spaced from said circular array of pockets for transporting sheet material assemblages, means for sequentially moving said grippers and sheet material assemblages engaged by said grippers from beneath said circular array of pockets to a location above said conveyor means and for changing the orientation of said grippers from the orientation in which said grippers open upwardly to an orientation in which said grippers open downwardly, and means for sequentially operating said grippers in the downwardly opening orientation and above said conveyor means to drop sheet material assemblages onto said conveyor means.

7. An apparatus as set forth in claim 6 wherein each of said grippers includes a first clamp member, a second clamp member movable relative to said first clamp member from a fully open position to any one of a plurality of closed positions to enable sheet material assemblages of different thicknesses to be gripped between said clamp members, clutch means operable between an engaged condition preventing movement of said second clamp member from any one of the plurality of closed positions to the open position and a release condition in which said second clamp member is movable from any one of the closed positions to the fully open position, said means for sequentially operating said grippers from the closed condition to the open condition including means for operating said clutch means from the engaged condition to the release condition.

8. An apparatus as set forth in claim 5 wherein said pockets and said grippers move at the same speed.

9. An apparatus as set forth in claim 5 wherein said apparatus further includes a receiving station arranged above said circular array of pockets and spaced therefrom, said gripper conveyor comprising a first arcuate section defining said arcuate path of movement of said grippers, first and second horizontal sections extending tangentially to said circular path of movement of said pockets and having one end thereof connected to a respective end of said arcuate section, a first vertical section having one end thereof connected to the other end of one of said first and second horizontal sections and extending upward therefrom, a third horizontal section having one end thereof connected to said vertical section and extending to said receiving station, a second arcuate section connecting said third horizontal section with a fourth horizontal section arranged above said third horizontal section, and a second vertical section connecting said fourth horizontal section with the other end of the other of said first and second horizontal sections.

* * * * *